US005701636A

United States Patent [19]

Jahnke

[11] Patent Number: 5,701,636

[45] Date of Patent: Dec. 30, 1997

[54] ADJUSTABLE DOOR HINGE

[75] Inventor: Wolfgang Jahnke, Wadersloh, Germany

[73] Assignee: Simonswerk GmbH, Rheda-Wiedenbruck, Germany

[21] Appl. No.: 489,486

[22] Filed: Jun. 12, 1995

[30] Foreign Application Priority Data

Jun. 17, 1994 [DE] Germany ..... P 44 21 056.6

[51] Int. Cl.[6] ..... E05D 7/04

[52] U.S. Cl. ..... 16/238; 16/237

[58] Field of Search ..... 16/237, 238, 241, 16/240, 235, 236, 239, 243, 245, 248

[56] References Cited

U.S. PATENT DOCUMENTS

| | | | |
|---|---|---|---|
| 4,825,507 | 5/1989 | Killingstad | 16/241 |
| 5,339,493 | 8/1994 | MacIntyre | 16/237 |

FOREIGN PATENT DOCUMENTS

| | | | |
|---|---|---|---|
| 0 140 114 | 5/1985 | European Pat. Off. . | |
| 2 392 206 | 2/1978 | France . | |
| 2 411 292 | 10/1978 | France . | |
| 1 276 500 | 8/1968 | Germany . | |
| 30 04 313 | 8/1981 | Germany . | |
| 37 39 810 | 2/1989 | Germany . | |
| 92 00 563 | 5/1992 | Germany . | |
| 3-39581 | 2/1991 | Japan | 16/243 |
| 2032994 | 5/1989 | United Kingdom | 16/237 |

*Primary Examiner*—Daniel W. Howell
*Assistant Examiner*—Christopher Kirkman
*Attorney, Agent, or Firm*—Herbert Dubno; Andrew Wilford

[57] ABSTRACT

An adjustable hinge for mounting a movable door element to a frame element has a plain leaf adapted to be secured to one of the elements and having at least one knuckle, a pintle passing through the knuckle along a pintle axis, and an adjustable leaf. This adjustable leaf has a plate formed with at least one knuckle aligned with the knuckle of the plain leaf and also traversed by the pintle, and a housing adapted to be secured to the other of the elements and formed with a slot receiving the plate. The slot forms a fulcrum for pivoting of the plate relative to the housing about an adjustment axis parallel to but offset from the pintle axis through a multiplicity of angularly offset positions. An adjustable element is provided for fixing the plate in the slot in any of the angularly offset positions. In addition the plate is displaceable parallel to the axis in the housing. The hinge further has at least one axially extending screw braced between the plate and the housing and rotatable for axially displacing the plate in the housing parallel to the axes. This additional axial adjustability can be provided in addition to or instead of the front-to-back transverse adjustability.

8 Claims, 3 Drawing Sheets

ADJUSTABLE DOOR HINGE

FIELD OF THE INVENTION

The present invention relates to a hinge assembly. More particularly this invention concerns an adjustable pin-type door hinge.

BACKGROUND OF THE INVENTION

An adjustable hinge normally comprises a plain leaf that is set in a door or frame element and an adjustable leaf that is set in the frame or door element to be hinged to the other element. The adjustable leaf comprises a housing in which can be secured a plate carrying one or more knuckles that are interleaved with the knuckle or knuckles of the plain leaf and interconnected by a pintle.

For installation the plain leaf and the housing of the adjustable leaf are mounted on their respective elements. Then one worker fits the door to the frame so as to engage the adjustable-leaf plate in its housing, and another worker secures it in place therein by means of at least two adjustment screws per hinge. Any minor offset can be compensated for during such assembly by securing the adjustable-leaf plate in the housing in any of a multiplicity of different positions. If subsequently either the front-to-back position, that is the position of the adjustable-leaf plate in a direction perpendicular to the plane of the adjustable leaf, or the axial position, that is parallel to the pintle axis, has to be changed, both adjustment screws have to be loosened and the hinge has to be reset completely. Clearly this is a cumbersome system that is at best hard to install, use, and adjust.

OBJECTS OF THE INVENTION

It is therefore an object of the present invention to provide an improved adjustable hinge assembly.

Another object is the provision of an improved adjustable hinge which overcomes the above-given disadvantages, that is which is easy to install, use, and adjust.

SUMMARY OF THE INVENTION

An adjustable hinge for mounting a movable door element to a frame element has according to the invention a plain leaf adapted to be secured to one of the elements and having at least one knuckle, a pintle passing through the knuckle along a pintle axis, and an adjustable leaf. This adjustable leaf has a plate formed with at least one knuckle aligned with the knuckle of the plain leaf and also traversed by the pintle, and a housing adapted to be secured to the other of the elements and formed with a slot receiving the plate. The slot forms a fulcrum for pivoting of the plate relative to the housing about an adjustment axis parallel to but offset from the pintle axis through a multiplicity of angularly offset positions. An adjustable element is provided for fixing the plate in the slot in any of the angularly offset positions.

Thus with this hinge the front-to-back position of the knuckle can be adjusted before or after the hinge is installed between the door and the frame element. This makes it possible to finely adjust the installation very easily, with only one person.

According to the invention the slot is open toward the pintle axis, has a mouth at the adjustment axis with a width equal substantially to a thickness of the plate, and is of greater width on a side of the mouth remote from the pintle axis so that the mouth forms a fulcrum defining the adjustment axis. The housing has a pair of cheeks having flat faces defining the slot and diverging away from the mouth. In addition the plate is provided with at least two pins offset from and spaced apart relative to the adjustment axis and projecting transversely toward the cheek faces. The cheek faces are formed with respective grooves receiving the pins and extending parallel to the adjustment axis so that the plate can move axially with the pins sliding in the grooves.

The adjustment element according to the invention is a transverse adjustment screw engaged between the plate and the housing and offset from the adjustment axis for pivoting the plate about the adjustment axis on rotation of the screw. The plate is formed with a transversely throughgoing threaded hole in which the adjustment screw is engaged. The housing has a pair of cheeks bearing on ends of the adjustment screw. This screw has one end formed with a tool recess and the respective cheek of the housing is formed with a throughgoing hole giving access to the tool recess so that a tool can be inserted through the hole to rotate the screw and pivot the plate. The hole is elongated parallel to the adjustment axis.

According to another aspect of the invention the plate is displaceable parallel to the axis in the housing. The hinge further has according to the invention means including at least one axially extending screw braced between the plate and the housing and rotatable for axially displacing the plate in the housing parallel to the axes. This additional axial adjustability can be provided in addition to or instead of the front-to-back transverse adjustability.

With axial adjustability it is possible to compensate for imperfect positioning the hinges. If they are a little too close or far apart the hinge can be compensated for to adjust out the difference. This is particularly usable in a three-hinge installation where getting the center hinge in the perfect position is often fairly difficult.

The adjustable leaf further includes a nut fixed in the housing and threadedly receiving the screw. The plate is axially coupled to the screw, and another adjustment element can rotate rotating the screw and thereby axially displace the plate in the housing. The screw has an enlarged head and the plate is formed with an axially open cutout complementary to the screw and its head and receiving the screw and its head. The second adjustment element a worm gear rotatable in the housing about an axis transverse to a plane defined by the pintle and adjustment axes and meshing with gear teeth formed on the screw.

The housing according to the invention has as mentioned above a pair of cheeks and the worm is journaled in the cheeks. The worm has at one end a tool recess and the respective cheek is formed with a throughgoing hole giving access to the tool recess so that a tool can be inserted through the hole to rotate the screw and axially move the plate.

A hinge assembly according to this invention has at least one hinge with front-to-back adjustability and one with axial adjustability. In a three-hinge system the center hinge has both degrees of adjustability and the end hinges can have only front-to-back adjustability, although to compensate for off-tolerance installations it is frequently advisable for all but one of the hinges to have axial adjustability too.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
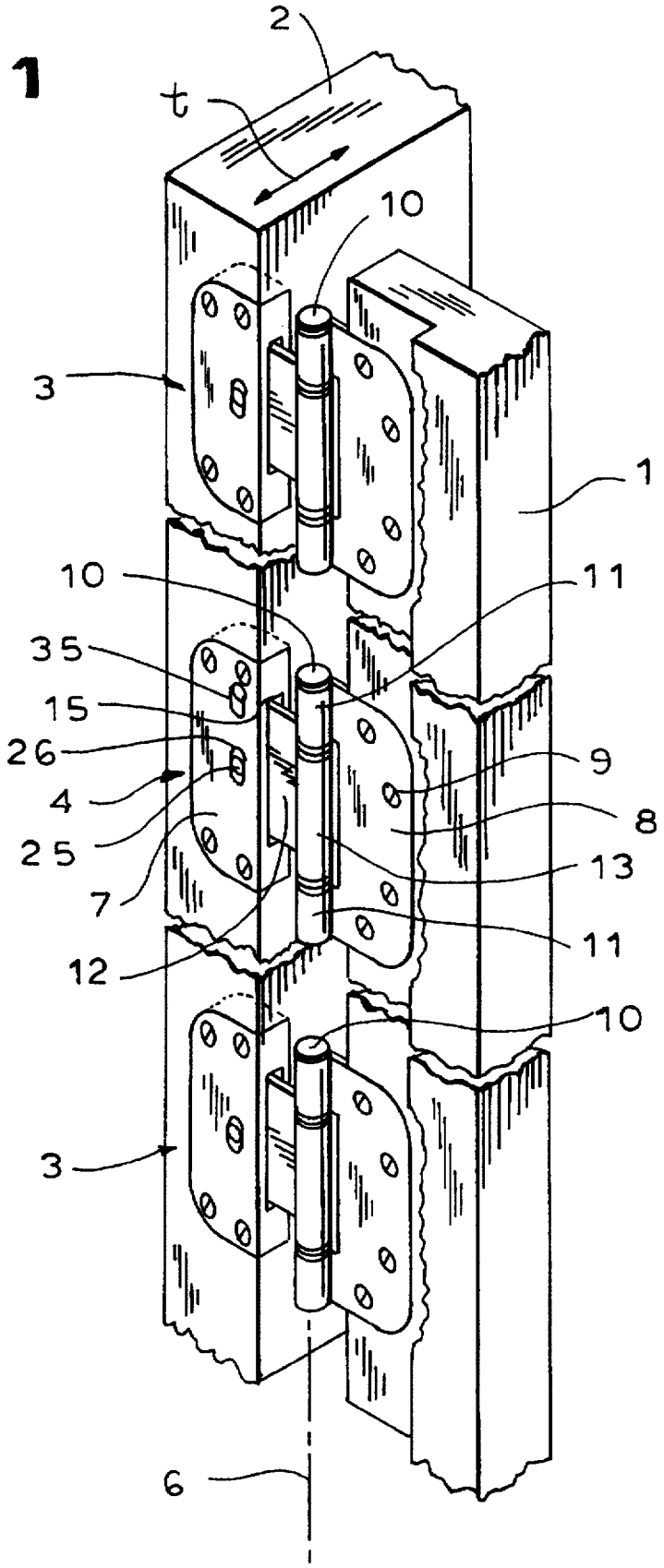
FIG. 1 is a perspective view of a hinge assembly according to the invention.
Figures 2, 3, 4:
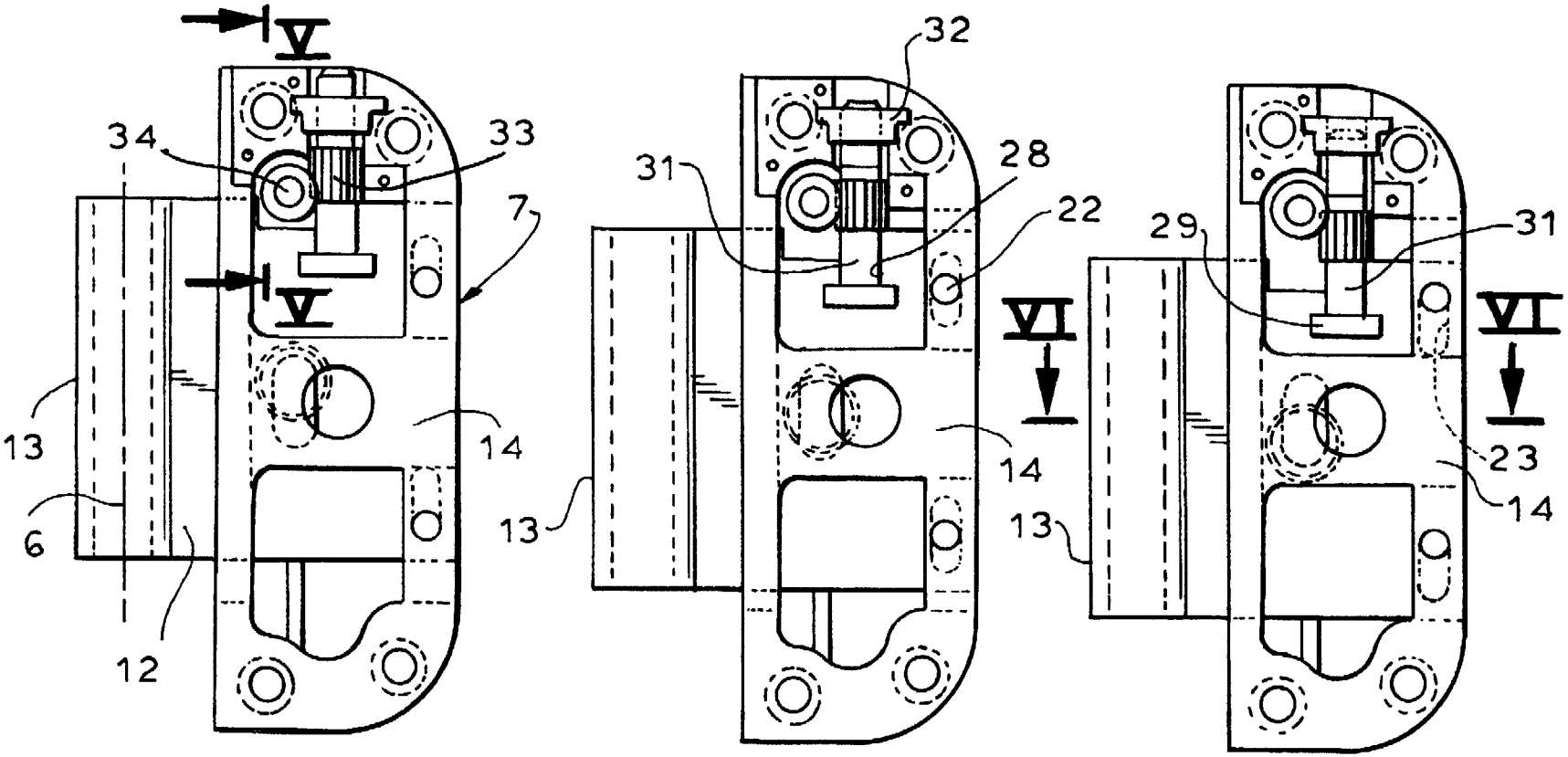
FIGS. 2, 3, and 4 are back views of the adjustable hinge leaf of the invention in three different axial positions.
Figure 6:
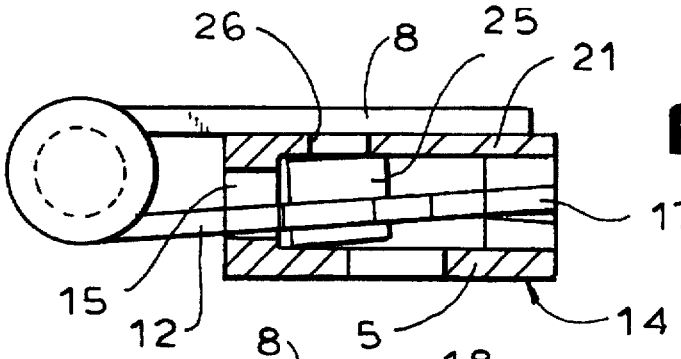
FIGS. 6, 7, and 8 are sections corresponding to line VI—VI of FIG. 4 showing the adjustable hinge leaf in three different front-to-back positions.
Figure 7:
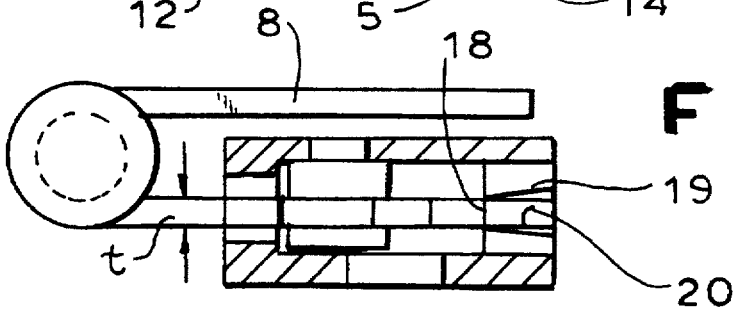
Figure 8:
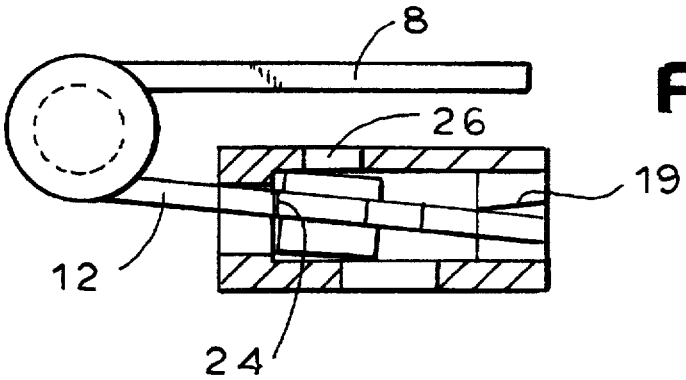
Figure 5:
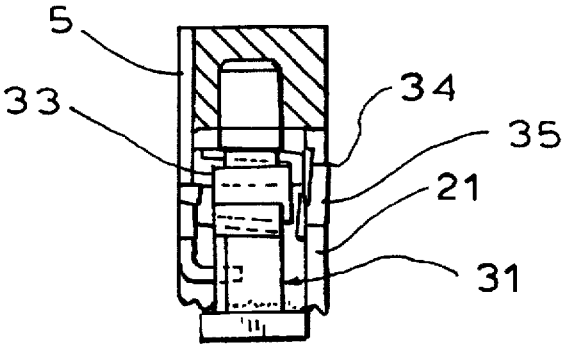
FIG. 5 is a section taken along line V—V of FIG. 2.

As seen in FIG. 1 a hinge assembly according to this invention is used to mount a door 2 on a frame 1 for pivoting of the door 2 about an axis 6 relative to the normally stationary frame 1. The assembly comprises two outer hinges 3 and a middle hinge 4. The middle hinge 4 is adjustable as will be described below parallel to the axis 6 and in a direction T transverse thereto, while the end hinges 3 are adjustable only parallel to the axis 6, although all three hinges could of course have two degrees of adjustability like the middle hinge 4.

Each hinge comprises an adjustable leaf 7 that is mortised into the edge of the door 2 and that carries a standard center hinge knuckle 13 and a plain leaf 8 set in the frame 1. Screws 9 secure the leaves 7 and 8 in place and the plain leaves 8 each have two knuckles 11 flanking the respective center knuckle 13 and coupled thereto by a pintle 10 lying on the axis 6.

More particularly as shown in FIGS. 2 through 8, each adjustable leaf 7 has a plate 12 carrying the respective knuckle 13 and fitting into a housing 14 that is as mentioned above mortised into the edge of the door 2 and that is hollow, with an inside cheek 5 and an outside cheek 21. To this end the housing 14 is formed with an outwardly open rectangular slot 15 of a width and length substantially greater than the width measured in direction T and length measured parallel to the axis 6 of the plate 12 so that same can move axially and transversely therein.

At its inner side remote from the slot 15 the cheeks 5 and 21 of the housing 14 form a slot 17 having a relatively narrow mouth or outer edge 18 and a pair of inwardly diverging sides 19 and 20. The width of the mouth 18 is substantially equal to a thickness t (See FIG. 7) of the plate 12. Two axially spaced but perpendicularly extending and projecting pins 22 set in the plate 12 engage in axially elongated grooves or holes 23 cut in the sides 19 and 20 so that the plate 12 can move axially but not in a direction parallel to its plane and perpendicular to the axis 6. The plate 12 can pivot about a fulcrum defined by outer edge 18 of the slot 17, that is so the knuckle 13 moves in direction T.

In addition the plate 12 is formed outward of this fulcrum-forming outer edge 18 with a threaded throughgoing hole 24 in which is seated a threaded pin 25 having ends bearing on opposite inside faces of the housing cheeks 5 and 21. An axially elongated hole 26 in the outside cheek 5 of the housing gives access to a tool recess, for instance a square-section hole, in the end of the pin 25. Thus rotation of the pin 25 by a tool inserted through the hole 26 can rock the leaf 12 about an axis defined by the front slot edge 18, thereby moving the knuckle 13 in the direction T perpendicular to the plate 12 and to the axis 6.

The plate 12 is furthermore formed with a T-shaped and axially open cutout 28 in which is fitted a bolt 31 having an enlarged head 29. This bolt 31 extends along an axis 30 parallel to the axis 6 and is threaded into a nut 32 fixed in an upper part of the housing 14. Centrally the bolt 31 is formed as a gear 33 meshing with a worm 34 journaled in the cheeks 5 and 21 of the housing 14 and having an end formed with a tool recess accessible through a hole 35 formed in the outer cheek 5 of the housing 14. Thus rotation of the worm 34 will rotate the bolt 31 about its axis 30 and displace the plate 12 parallel to the axis 6. This mechanism need not be provided on both of the end hinges 3 although it would do no harm thereon.

With such a system the three plain leaves 8 are mortised into the edge of the frame 1 and the three adjustable leaves 4 are mortised into the edge of the door 2, without coupling them together by the pintles 10. Then the two end hinges are coupled up by means of their pintles 10. The axial position of the middle hinge 4 is adjusted by means of the worm 34, and its front-to-back position by means of the screw 25 until its pintle 10 can also be installed. Then the overall front-to-back position of the door 2 can be adjusted by means of the screws 25, ensuring a flush fit. Thus even if the mortises are not perfectly positioned, the hinges 3 and 4 can adjust to compensate and the door 2 can be fitted perfectly.

Each adjustment, that is parallel to the axis 6 or perpendicular thereto in the direction T, can be carried out independently of and without affecting the other setting. Furthermore the adjustments can be done by a single worker even after the door is installed.

I claim:

1. An adjustable hinge for mounting a movable door element to a frame element, the hinge comprising:

a plain leaf adapted to be secured to one of the elements and having at least one knuckle;

a pintle passing through the knuckle along a pintle axis; and an adjustable leaf having an adjustment axis parallel to the pintle axis and including a plate formed with at least one knuckle aligned with the knuckle of the plain leaf and also traversed by the pintle, and a housing adapted to be secured to the other of the elements and formed with a slot receiving the plate with axial play, whereby the plate can move axially of the housing in the slot, a nut axially fixed in the housing and having a nut axis parallel to the pintle axis, a worm rotatable on the housing about an axis transverse to a plane defined by the pintle and adjustment axes, and means including at least one axially extending screw braced between the plate and the housing, threaded into the nut, having an enlarged head axially coupling the screw to the plate, formed with gear teeth meshing with the worm, and rotatable by means of the worm for axially displacing the plate in the housing parallel to the pintle and adjustment axes.

2. The adjustable hinge defined in claim 1 wherein the plate is formed with an axially open cutout complementary to the screw and its head and receiving the screw and its head.

3. The adjustable hinge defined in claim 1 wherein the housing has a pair of cheeks and the worm is journaled in the cheeks, the worm having at one end a tool recess and the respective cheek being formed with a throughgoing hole giving access to the tool recess, whereby a tool can be inserted through the hole to rotate the worm, thereby rotating the screw and axially moving the plate.

4. The adjustable hinge defined in claim 1 wherein the housing is provided in the slot with fulcrum means for pivoting of the plate relative to the housing about an adjustment axis parallel to but offset from the pintle axis through a multiplicity of angularly offset positions, the housing further having means for fixing the plate in the slot in any of the angularly offset positions.

5. The adjustable hinge defined in claim 4 wherein the slot is open toward the pintle axis, has a mouth at the adjustment axis with a width equal substantially to a thickness of the plate, and is of greater width on a side of the mouth remote from the pintle axis, whereby the mouth forms a fulcrum defining the adjustment axis.

6. The adjustable door hinge defined in claim 5 wherein the housing has a pair of cheeks having flat faces defining the slot and diverging away from the mouth.

7. The adjustable door hinge defined in claim 6 wherein the plate is provided with at least two pins offset from and spaced apart relative to the adjustment axis and projecting transversely toward the cheek faces, the cheek faces being formed with respective grooves receiving the pins and extending parallel to the adjustment axis, whereby the plate can move axially with the pins sliding in the grooves.

8. The adjustable door hinge defined in claim 4 further comprising means including a transverse adjustment screw engaged between the plate and the housing and offset from the adjustment axis for pivoting the plate about the adjustment axis on rotation of the screw.

* * * * *